US006455810B1

(12) United States Patent
Preston et al.

(10) Patent No.: US 6,455,810 B1
(45) Date of Patent: Sep. 24, 2002

(54) STEPPED DRUM OR STEPPED HOLD-DOWN-ROLLERS FOR HEAT PROCESSABLE MEDIA

(75) Inventors: James R. Preston, San Jose, CA (US); John C. Boutet, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/849,862

(22) Filed: May 4, 2001

(51) Int. Cl.[7] ..... G03D 13/00; G03G 15/10; G03L 15/00

(52) U.S. Cl. ..... 219/216; 219/469; 396/571; 430/350

(58) Field of Search ..... 219/216, 469; 432/60, 228; 399/279, 286; 430/353, 354

(56) References Cited

U.S. PATENT DOCUMENTS 5,338,893 A * 8/1994 Edmunds et al. ..... 399/266
5,465,146 A 11/1995 Higashi
5,583,556 A 12/1996 Kim
5,995,792 A * 11/1999 Jo ..... 399/286
6,042,228 A 3/2000 Yamada
6,297,476 B1 * 10/2001 Kashino et al. ..... 219/216

* cited by examiner

*Primary Examiner*—Joseph Pelham
(74) *Attorney, Agent, or Firm*—William F. Noval

(57) ABSTRACT

Apparatus for processing heat processable media comprising: a rotatable heated drum for processing heat processable media having width and depth dimensions, and a plurality of rollers spaced around a portion of the periphery of said drum and in contact therewith, said rollers holding said media to said drum; wherein at least one of said drum and/or at least some of said plurality of rollers have a channel in a central region thereof, said channel having a width greater than said width dimension of said media and a depth less than said thickness dimension of said media.

5 Claims, 2 Drawing Sheets

STEPPED DRUM OR STEPPED HOLD-DOWN-ROLLERS FOR HEAT PROCESSABLE MEDIA

FIELD OF THE INVENTION

This invention relates in general to heat processable media imaging systems and more particularly to such systems that have reduced maintenance costs and more reliable image quality performance.

BACKGROUND OF THE INVENTION

One way of heat processing photothermographic media in a processor is to bring it in contact with a heated drum. To maintain good media contract with the drum a plurality of hold-down-rollers can be used to hold the media against the drum. During processing, some of the silver behenate in the media emulsion is converted to silver behenic acid. Some of the behenic acids and other byproducts of the processing reactions can leach through the media emulsion overcoat. These escaped chemicals are referred to as FAZ. At processing temperatures, the escaping FAZ is liquid. The FAZ ends up coating the drum surface where the media makes contact. After the media leaves the drum, the FAZ liquid left behind goes through changes. If the media hold-down-rollers contact the drum surface after the media has passed, some FAZ transfers to the contacting roller surfaces. Retained coating solvents and other light molecules in the FAZ quickly evaporated off the FAZ liquid surface. The remaining less volatile molecules can continue to slowly react with one another, with gasses diffusing in from the liquid/air surface and with the solid surfaces on which the FAZ clings. In some cases, FAZ reactions can form solid particles which can either remain in suspension in the FAZ liquid or deposit on the drum or rollers. FAZ, which is not attached to the surfaces as a solid deposit, is subsequently diluted by FAZ leaching from the next sheet of media processed. Some of this FAZ mixture leaves the drum as a surface deposit on the media overcoat. Ideally, the system would reach a steady state condition in which the quantity FAZ leaching out of the media equals the evaporation quantity plus the quantity exiting the processor on the surface of the sheet of media. This is often not the case and eventually some solid deposits form on the drum and/or roller surfaces.

In processors where media hold-down-rollers contact the FAZ coated part of the processing drum, the solid surface area with which FAZ interacts approximately triples. Consequently, the FAZ surface exposed to air also. Roller/drum contact also introduces mechanical working of the FAZ surface deposits. The contacting roller nips also serve to repeatedly force dust and other dirt particles brought into the processor on the media to be repeatedly pressed against the drum and roller surfaces, increasing their chance of sticking to one or the other and becoming nucleation sites for FAZ deposits. Small but frequent thermal cycling of FAZ is introduced as the FAZ on the heated drum and cooling rollers pass through their contact nips where heat is exchanged. FAZ on the rollers also sees much larger cooling cycles as media comes through, cooling the rollers significantly. All of these factors can serve to drive chemical reactions which might be absent in an undisturbed FAZ drum coating.

Although stepped drums or rollers have been used in reproduction systems (see: U.S. Pat. No. 5,465,146, issued Nov. 7, 1995, inventors Higashi et al.—Stepped Roller in a Fuser; U.S. Pat. No. 5,583,556, issued Dec. 10, 1996, inventor Kim—Stepped Drum in a Thermal Transfer Type Printer; U.S. Pat. No. 6,042,228, issued Mar. 28, 2000, inventors Yamada et al.—Stepped Rollers for Feeding Roll Sheets in an Image Forming Apparatus), none are suitable for solving any of these problems.

SUMMARY OF THE INVENTION

According to the present invention, there is provided a solution to these problems. The frequency and time required for preventive maintenance of a photothermographic processor can be significantly reduced by the use of stepped rollers or of a stepped drum design. In such a system the rollers and drum surface are gapped and do not touch each other in the central zone where they make media contact during media transport. This prevents the media hold-down-rollers from touching the processing residue coating (FAZ) on the drum. In either of these designs, an undercut that is about ⅝ the thickness of the media to be transported is used either on the drum or on the rollers in the media contact area. During standby, while film is not being processed the drum and rollers are gapped and only make rolling contact on either side of the film path. As film is transported through such a processor, it lifts the rollers by about ⅜ the media thickness, providing the full clamping force of the rollers against the film to ensure contact of the media against the hot processing drum.

According to a feature of the present invention, there is provided an apparatus for processing heat processable media comprising: a rotatable heated drum for processing heat processable media, having width and depth dimensions; and a plurality of rollers spaced around a portion of the periphery of said drum and in contact therewith, said rollers holding said media to said drum; wherein at least one of said drum or at least some of said plurality of rollers have a channel in a central region thereof, said channel having a width greater than said width dimension of said media and a depth less than said thickness dimension of said media.

ADVANTAGEOUS EFFECT OF THE INVENTION

The invention has the following advantages.

1. Reduced maintenance time and costs.
2. More reliable image quality performance.
3. Increased life of system components.
4. Reduced need for strong chemical cleaners

DETAILED DESCRIPTION OF THE INVENTION

Figure 1:
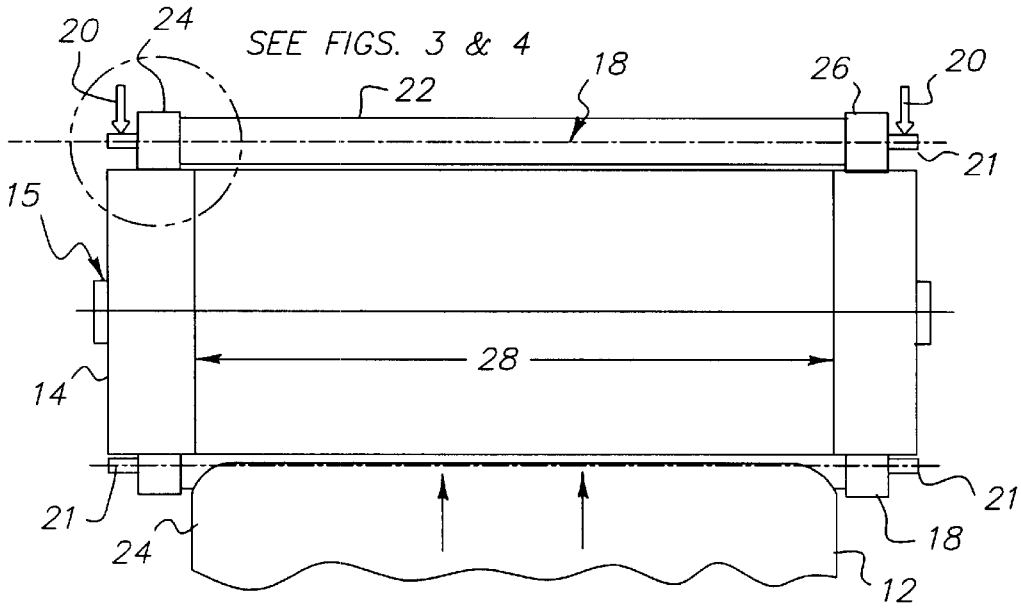
FIGS. 1–4 are diagrammatic views of one embodiment of the present invention.
Figure 2:
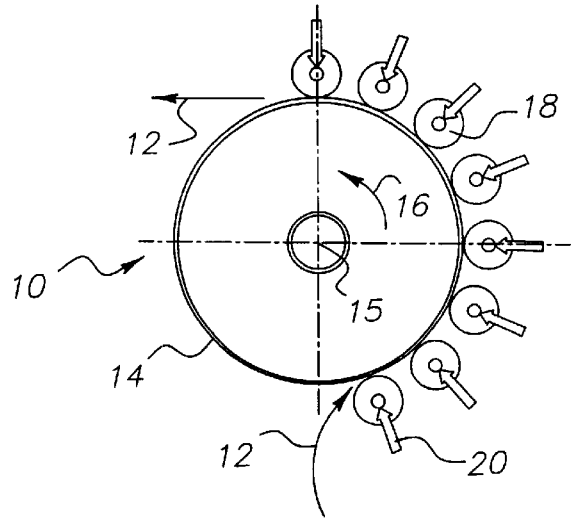

Referring now to FIGS. 1–4, there will be described one embodiment of the present invention. As shown in FIGS. 1 and 2, a processor 10 for processing heat processable media 12 (such as photothermographic sheets exposed to medical images) includes a heated drum 14 which rotates about axis 15 in direction 16. Drum 14 preferably has an outer elastomeric layer for improved processing. A plurality of rollers 18 are spaced around a portion of the periphery of drum 14 to hold media 12 in contact with drum 14. Rollers 18 are biased into contact with drum 14 by springs 20 bearing on axles 21 of roller 18. According to the present invention roller 18 is stepped and includes annular channel 22 in the central region thereof and annular shoulders 24, 26 on either end of channel 22.

Figure 3:
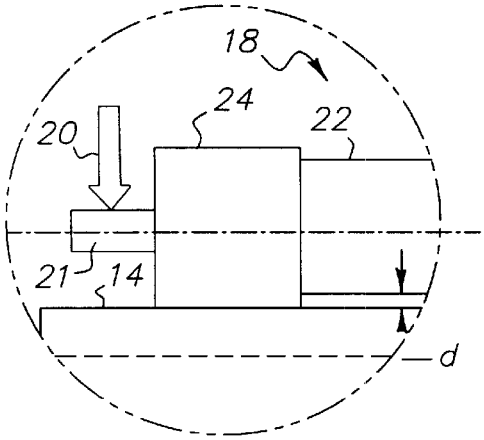
Figure 4:
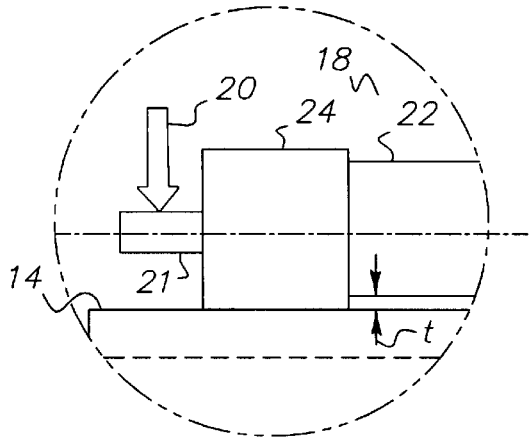
Figure 5:
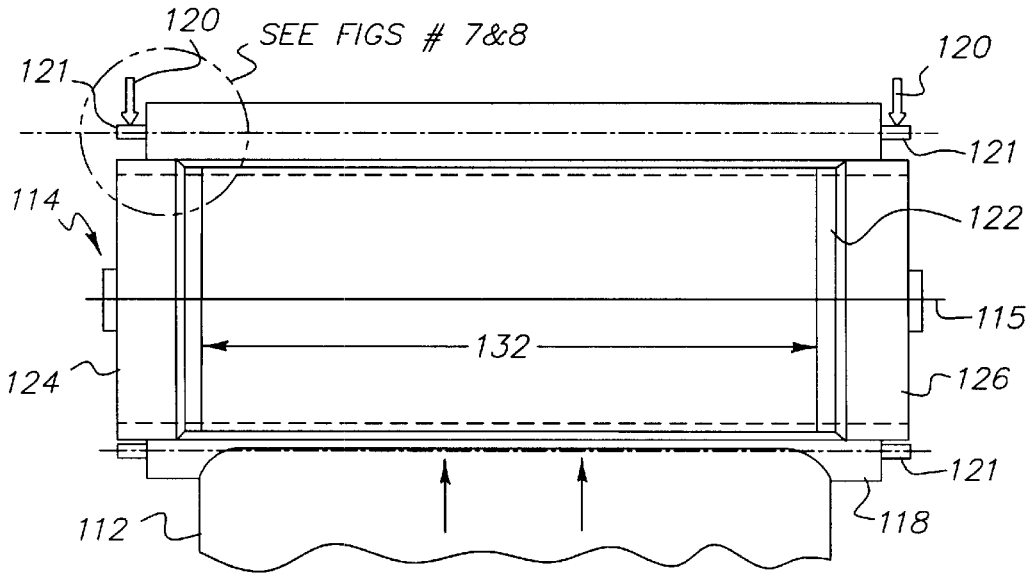
FIGS. 5–8 are diagrammatic views of another embodiment of the present invention.
Figure 6:
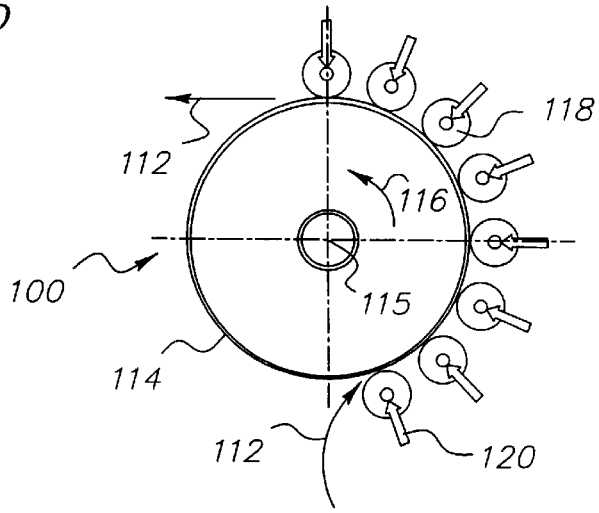

Channel 22 has a width which is greater than the width of the widest media processed by processor 10. Channel 22 has a depth d which is less than the thickness of processed media (see: FIGS. 3 and 4). Preferably, d equals ⅝ t.

The shaded region 28 (FIG. 1) is the media contact area.

In Operation, when media is not present, rollers 18 ride on drum 14 by means of shoulders 24, 26 of roller 18 contacting drum 14 outside of the media contact area 28 of drum 14. When media 12 is processed by drum 14, the media 12 lifts roller shoulders 24, 26 off of drum 14 until media 12 passes by the lifted roller.

It was found that the stepped roller configuration increased the number of media that can be processed before preventative maintenance was required by a substantial factor, thus substantially reducing the probability of drum damage by a like factor. FAZ and image artifacts were substantially reduced.

Referring now to FIGS. 5–8, there will be described another embodiment of the present invention. As shown, processor 100 for processing heat processable media 112, includes a heated drum 114 rotatable about axis 115 in direction 116. A plurality of rollers 118 are disposed about a portion of the periphery of drum 114 and are biased into contact with drum 114 by springs 120 bearing on axles 121 of roller 118. Rollers 118 hold media 112 against heated drum 114 to effect heat processing of exposed media 112.

Figure 7:
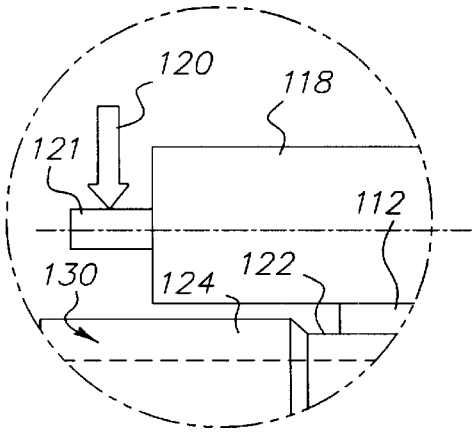
Figure 8:
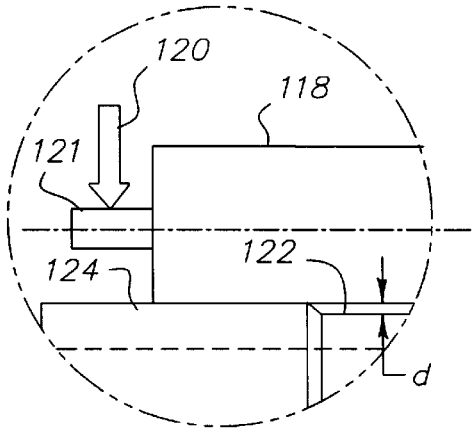

According to the present invention, drum 114 has an annular channel 122 in the central region thereof with outer shoulders 124,126 of greater diameter than annular channel 122. Channel 122 has a width that is greater than the widest media 112 processed by processor 100 and a depth d which is less than the thickness of media 112. Preferably d=⅝ t. For example, for media thickness of 8 mils., the depth of channel 122 is preferably 5 mils. The depth should be great enough to compensate for any bowing of rollers 118 at the center thereof. As shown in FIG. 7, drum has an elastomeric coating 130 from which channel 122 is ground. If coating 130 has a thickness of 30 mils. at shoulder 124, its thickness at channel 122 can be 25 mils.

The shaded area 132 is the media contact area.

In operation, when media 112 is not present (FIG. 8) roller 118 rides on shoulders 124,126 of drum 114. When media 112 is processed by heated drum 114, media 112 left rollers 188 off of drum 114 until media 112 passes by the lifted roller.

It was found that the stepped drum configuration increased the number of media that can be processed before preventative maintenance was required by a substantial factor, thus substantially reducing the probability of drum damage by a like factor. FAZ and image artifacts were substantially reduced.

It will be appreciated that it is within the scope of the present invention to combining a stepped drum with stepped rollers to accomplish the same advantages resulting form the use of one or the other alone. In such case, the combined depth of the drum and roller channels should be less than the thickness of the processed media.

The invention has been described in detail with particular reference to certain preferred embodiments thereof, but it will be understood that variations and modifications can be effected within the spirit and scope of the invention.

PARTS LIST

10 processor
12 media
14 heated drum
15 axis
16 direction
18 rollers
22 annular channel
24,26 annular shoulders
28 region
100 processor
112 media
114 heated drum
116 direction
118 rollers
120 springs
121 axles
122 annular channel
124,126 outer shoulders
130 elastomeric coating
132 shaded area

What is claimed is:

1. Apparatus for processing heat processable media comprising:

a rotatable heated drum for processing heat processable media having width and depth dimensions; and a plurality of rollers spaced around a portion of the periphery of said drum and in contact therewith, said rollers holding said media to said drum;

wherein at least one of said drum and/or at least some of said plurality of rollers have a channel in a central region thereof, said channel having a width greater than said width dimension of said media and a depth less than said thickness dimension of said media.

2. The apparatus of claim 1 wherein said drum has an annular channel in said central region thereof.

3. The apparatus of claim 1 wherein said at least some of said plurality of rollers have annular channels in said central regions thereof.

4. The apparatus of claim 1 wherein said channel has a depth sufficient to avoid contact between said rollers and said drum in said central region but to bowing of said rollers.

5. The apparatus of claim 1 wherein said drum and at least some of said plurality of rollers have complimentary annular channels in the central regions thereof.

* * * * *